US010608356B2

(12) United States Patent
Spitzner

(10) Patent No.: US 10,608,356 B2
(45) Date of Patent: Mar. 31, 2020

(54) MULTIPLE NODE BUS BAR CONTACTS FOR HIGH-POWER ELECTRONIC ASSEMBLIES

(71) Applicant: L3 Technologies, Inc., New York, NY (US)

(72) Inventor: Matthew J. Spitzner, Lowry Crossing, TX (US)

(73) Assignee: L-3 Technologies, Inc., New York, NY (US)

( * ) Notice: Subject to any disclaimer, the term of this patent is extended or adjusted under 35 U.S.C. 154(b) by 0 days.

(21) Appl. No.: 16/117,720

(22) Filed: Aug. 30, 2018

(65) Prior Publication Data

US 2020/0076100 A1 Mar. 5, 2020

(51) Int. Cl.

| | |
|---|---|
| ***H01R 12/71*** | (2011.01) |
| ***H01R 12/58*** | (2011.01) |
| *H01R 4/30* | (2006.01) |

(52) U.S. Cl.
CPC ..... *H01R 12/71* (2013.01); *H01R 12/58* (2013.01); *H01R 4/30* (2013.01)

(58) Field of Classification Search
CPC ..... H01R 12/71; H01R 12/58; H01R 4/03
See application file for complete search history.

(56) References Cited

U.S. PATENT DOCUMENTS

| | | | | |
|---|---|---|---|---|
| 5,017,145 | A * | 5/1991 | Kanai | H02B 1/207 29/850 |
| 5,242,319 | A * | 9/1993 | Ju | H01R 31/06 439/654 |
| 5,456,608 | A * | 10/1995 | Rogers | H01R 29/00 29/845 |
| 5,544,004 | A * | 8/1996 | Inagaki | H02B 1/207 200/175 |
| 6,024,589 | A | 2/2000 | Hahn, IV et al. | |
| 6,102,754 | A | 8/2000 | Capper et al. | |
| 6,127,835 | A * | 10/2000 | Kocher | G01R 1/07378 324/750.25 |
| 6,205,029 | B1 | 3/2001 | Byrne et al. | |
| 6,302,709 | B1 | 10/2001 | Ross | |
| 6,327,157 | B1 | 12/2001 | Mann et al. | |
| 6,386,888 | B1 * | 5/2002 | Skopic | H01R 24/50 439/581 |

(Continued)

*Primary Examiner* — Truc T Nguyen
(74) *Attorney, Agent, or Firm* — Egan Peterman Enders Huston

(57) ABSTRACT

Multiple node bus bar contacts for high-power electronic assemblies are disclosed. The electronic assembly includes a plurality of circuit card assemblies (CCAs) for an electronic assembly, a plurality of socket connectors coupled within the plurality of CCAs, and a bus bar contact. The bus bar contact includes a rod positioned to extend through two or more socket connectors within two or more CCAs where the rod is in electrical contact with the two or more socket connectors, and the bus bar contact includes a bar coupled to the rod and having a first portion routed to an outer edge of the electronic assembly. In addition, the bar can also include a second portion with a connector, and the connector can be coupled to a bus bar providing electrical current for the electronic assembly. Further, a plurality of bus bar contacts can also be included within the electronic assembly.

16 Claims, 4 Drawing Sheets

(56) References Cited

U.S. PATENT DOCUMENTS 8,021,183 B2 * 9/2011 Early ..... H01R 13/665 439/382
2002/0004335 A1 * 1/2002 Onizuka ..... H01R 12/58 439/567
2002/0168882 A1 * 11/2002 Chiriku ..... H01R 9/2466 439/76.2
2004/0185698 A1 * 9/2004 Hara ..... H01R 9/226 439/212
2006/0035492 A1 * 2/2006 Sekido ..... H01R 13/112 439/100
2006/0154499 A1 * 7/2006 Naito ..... H05K 1/144 439/76.2
2007/0015409 A1 * 1/2007 Imbert ..... H05K 1/14 439/607.05
2007/0155202 A1 * 7/2007 Chuang ..... G06F 1/1616 439/131
2008/0025000 A1 * 1/2008 Huang ..... H05K 7/1409 361/726
2008/0038943 A1 * 2/2008 Hayakawa ..... H01R 9/2425 439/76.2
2008/0227311 A1 * 9/2008 Chan ..... H05K 1/0216 439/74
2008/0261459 A1 * 10/2008 Choi ..... H01R 9/2466 439/709
2008/0268671 A1 * 10/2008 Harris ..... H01H 85/046 439/76.2
2011/0051389 A1 * 3/2011 Goto ..... H01R 12/58 361/803
2012/0077359 A1 * 3/2012 Yamamoto ..... H05K 3/4046 439/78
2012/0145877 A1 * 6/2012 Chiu ..... G06F 1/20 248/674
2013/0265074 A1 * 10/2013 Sato ..... G01R 1/06711 324/755.01
2015/0072196 A1 3/2015 Soleski et al.

* cited by examiner

MULTIPLE NODE BUS BAR CONTACTS FOR HIGH-POWER ELECTRONIC ASSEMBLIES

TECHNICAL FIELD

The technical field relates to electrical connection systems for high current electronic assemblies.

BACKGROUND

Bus bar connection systems have been used in the past to connect electronic circuits for circuit card assemblies (CCAs) including high current electronic assemblies. High current electronic assemblies often receive their primary power from bus bars. Bus bars are typically large flat metal bars with a rectangular cross-section that run along the edges of a high current electronic systems including one or more CCAs. These large flat metal bars are then terminated to one or more CCAs within the electronic assembly using bus bar connectors. Current bus bar connectors are bulky and are typically mounted on the edge of a CCA to allow access to the bus bar.

With certain small form factor electronic systems, there is a need to accommodate an abundance of signal connectors in a small space. For existing systems, the routing of these signal connectors for CCAs within the electronic system is implemented at the edge of the assemblies. This edge routing, however, creates a space conflict between the system input/output signal connections and power connections through one or more bus bars that are also implemented at the edges of the electronic system assemblies.

SUMMARY OF THE INVENTION

Multiple node bus bar contacts for high-power electronic assemblies are disclosed. For the disclosed embodiments, the electronic assembly includes a plurality of circuit card assemblies (CCAs) for the electronic assembly, a plurality of socket connectors coupled within the plurality of CCAs, and a bus bar contact. The bus bar contact includes a rod positioned to extend through two or more socket connectors within two or more CCAs where the rod is in electrical contact with the two or more socket connectors, and the bus bar contact includes a bar coupled to the rod and having a first portion routed to an outer edge of the electronic assembly. For one embodiment, a plurality of bus bar contacts are included within the electronic assembly. Further, the bar can also include a second portion with a connector, and the connector can be coupled to a bus bar the provides electrical current for the electronic assembly. Other features and variations can also be implemented, and related assembly and methods can be utilized, as well.

For one embodiment, an electronic assembly is disclosed including a plurality of circuit card assemblies (CCAs) for the electronic assembly, a plurality of socket connectors coupled within the plurality of CCAs, and a bus bar contact. The buss bar contact includes a rod positioned to extend through two or more socket connectors within two or more CCAs with the rod being in electrical contact with the two or more socket connectors and includes a bar coupled to the rod and having a first portion routed to an outer edge of the electronic assembly. In further embodiments, a plurality of bus bar contacts are included within the electronic assembly.

In additional embodiments, the bus bar contact extends through and is in electrical contact with a socket connector in each of the CCAs. In further embodiments, the bus bar contact extends through an opening within at least one of the CCAs without making an electrical contact with the at least one CCA.

In additional embodiments, the electronic assembly further includes an additional bus bar contact without a bar extending to the outer edge of the electronic assembly, and the additional bus bar contact remains internal to the electronic assembly.

In additional embodiments, the bar also has a second portion with a connector. In further embodiments, the connector for the second portion of the bar is coupled to a bus bar for the electronic assembly. In further embodiments, the bus bar contact and the bus bar are configured to carry a current of 20 or more Amps during operation of the electronic assembly. In still further embodiments, the bus bar contact and the bus bar are configured to carry a voltage of between 1 to 100 volts during operation of the electronic assembly.

In additional embodiments, the first portion of the bar has flat surfaces and extends in a parallel plane with respect to at least one of the plurality of CCAs. In further embodiments, the first portion of the bar has multiple changes of direction within its routing to the outer edge of the electronic assembly. In further embodiments, the bar also has a second portion with a connector, and the second portion has flat surfaces and extends in a plane perpendicular to a plane for the first portion.

In additional embodiments, the plurality of CCAs each include a plurality of electronic components coupled to a board. In further embodiments, the bus bar contact includes copper or a copper alloy.

In additional embodiments, the electronic assembly also includes insulating material positioned adjacent at least a portion of the bus bar contact. In further embodiments, the insulating material includes an insulator tube positioned around the rod for the bus bar contact. In further embodiments, the insulating material includes one or more insulator layers positioned adjacent the bar for the bus bar contact. In still further embodiments, the insulating material includes a coating on at least a portion of the bar or the rod for the bus bar contact.

For one embodiment, a bus bar contact is disclosed including a bar having a first portion with a flat surface and a second portion with a connector and a rod coupled to the bar where the rod extends in an axial direction perpendicular to the flat surface of first portion of the bar. In further embodiments, the second portion has a flat surface that extends in a direction parallel to the axial direction for the rod.

Other features and variations can also be implemented, and related systems and methods can be utilized, as well.

DESCRIPTION OF THE DRAWINGS

It is noted that the appended drawings illustrate only example embodiments of the invention and are, therefore, not to be considered limiting of its scope, for the invention may admit to other equally effective embodiments.

DETAILED DESCRIPTION OF THE INVENTION

Multiple node bus bar contacts for high-power electronic assemblies are disclosed. The disclosed embodiments provide improved bus bar contacts that interconnect electronical circuits between multiple circuit card assemblies (CCAs). As described further below, the multiple node bus bar contact embodiments described herein allow high currents to be delivered within multiple CCAs simultaneously anywhere within the planar spaces of the circuit boards associated with the multiple CCAs. As one further advantage, the multiple node bus bar contacts described herein can use commercially available power connectors in conjunction with the embodiments described here. Further, the disclosed embodiments allow assembly layouts that minimize total board footprint while maximizing location flexibility of high current connections within the CCAs. Various additional and/or different features can also be implemented while still taking advantage of the bus bar contact embodiments and techniques described herein.

Figure 1B:
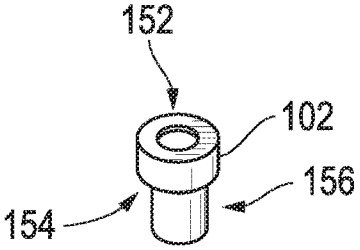
FIG. 1B provides a further perspective view of an example embodiment for the socket connector shown in FIG. 1A.
Figure 1C:
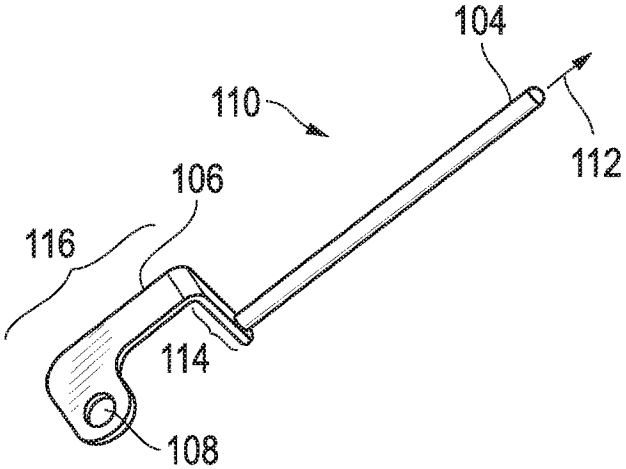
FIG. 1C provides a further perspective view of an example embodiment for the bus bar contact shown in FIG. 1A.
Figure 1A:
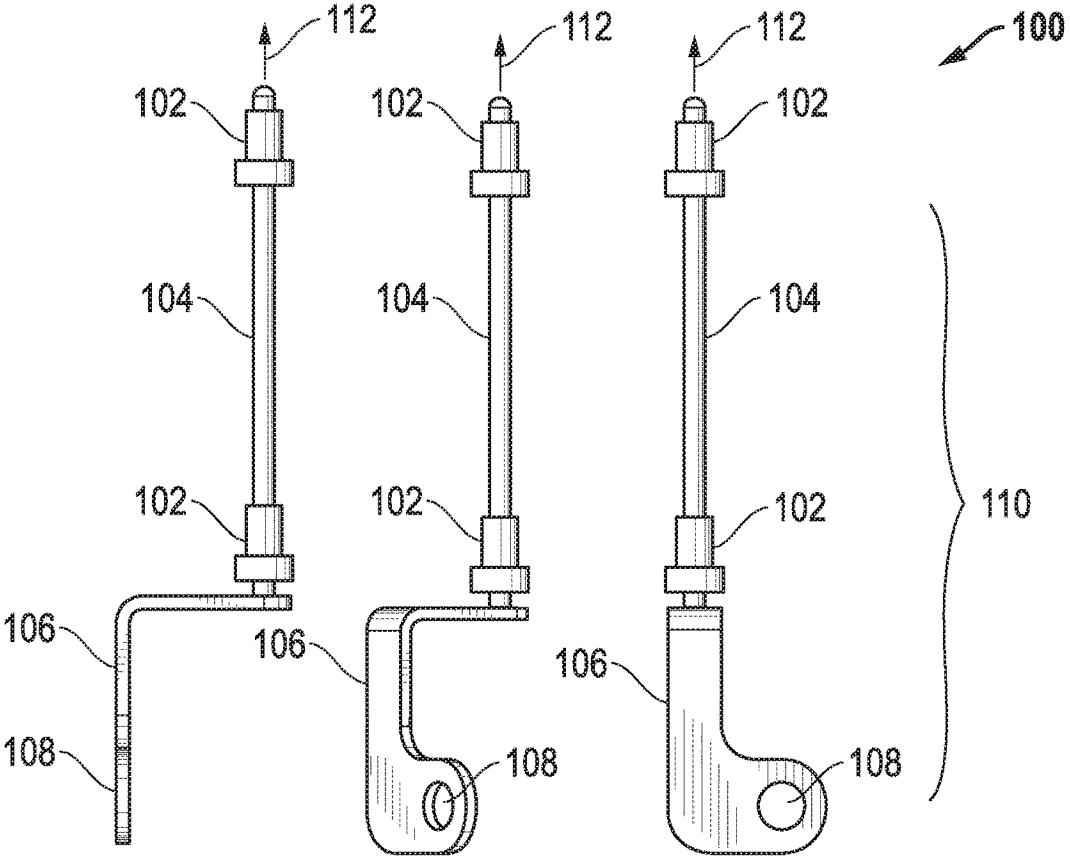
FIG. 1A provides an example embodiment for a multiple node bus bar contact system including a bus bar contact and socket connectors.

FIG. 1A provides an example embodiment 100 for a multiple node bus bar contact system including a bus bar contact 110 and socket connectors 102. The bus bar contact 110 includes a rod 104 and a bar 106 with a connector 108. For the embodiment depicted, three different orientations are shown for the bar 106, and the rod 104 extends from the bar 106 in an axial direction 112. The rod 104 can be implemented as a separate piece that is welded or otherwise coupled to the bar 106. The rod 104 and bar 106 can also be implemented as a single integral component that is molded or machined to a desired shape. The connector 108 is a hole through which a screw or pin can be inserted to couple the bar 106 to another electrical connection such as a bus bar that provides electronical current to the bus bar contact 110. As described further below, the rod 104 passes through one or more socket connectors 102 that are positioned within a plurality of CCAs to deliver electrical current and/or signals to electronic components and circuitry associated with the CCAs. The socket connectors 102 can be secured within openings formed within the CCAs, and the rod 104 passes through the socket connectors 102 so that the electrical current and/or signals can be simultaneously delivered to all of the connected CCAs.

For one embodiment, the rod 104 and the bar 106 for the bus bar contact 110 are made from copper. A copper alloy can also be used for these components bus bar contact 110, and the copper alloy can be materials such as brass, bronze, beryllium copper, and/or other copper alloys. Other materials can be used such as aluminum, and/or other conductive materials.

FIG. 1B provides a further perspective view for the socket connector 102. The socket connector 102 has a center axial borehole 152. The rod 104 extends through the borehole 152. The outer edge of the rod 104 contacts the interior wall of the borehole 152 so that an electrical connection is made between the rod 104 and the socket connector 102. This electrical connection allows for current to travel between the rod 104 and the socket connector 102.

Figure 4:
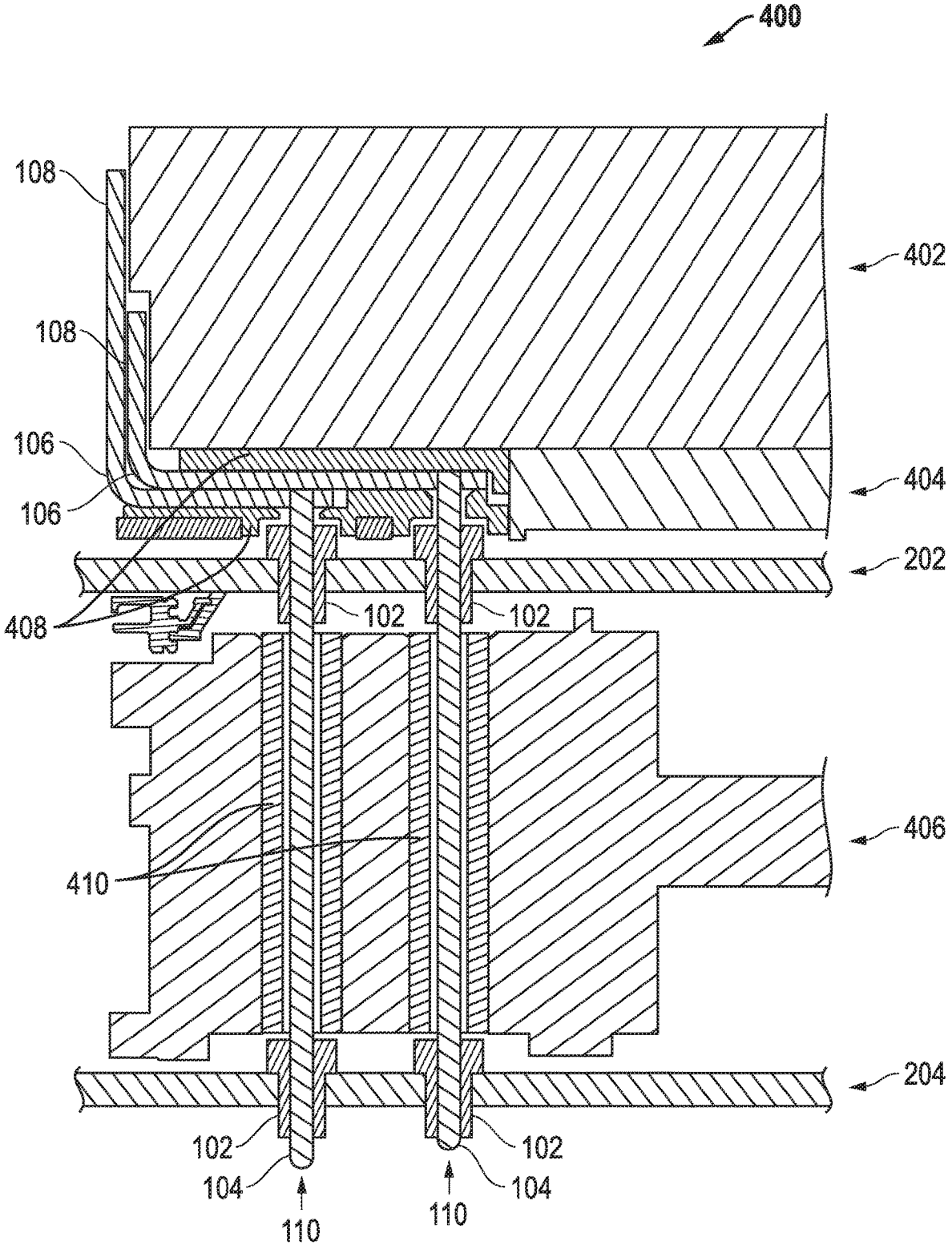
FIG. 4 provides an example embodiment for a cross-section view of an overall electronic assembly that includes metal structures in addition to two circuit card assemblies similar to what is shown in FIG. 2.
Figure 5:
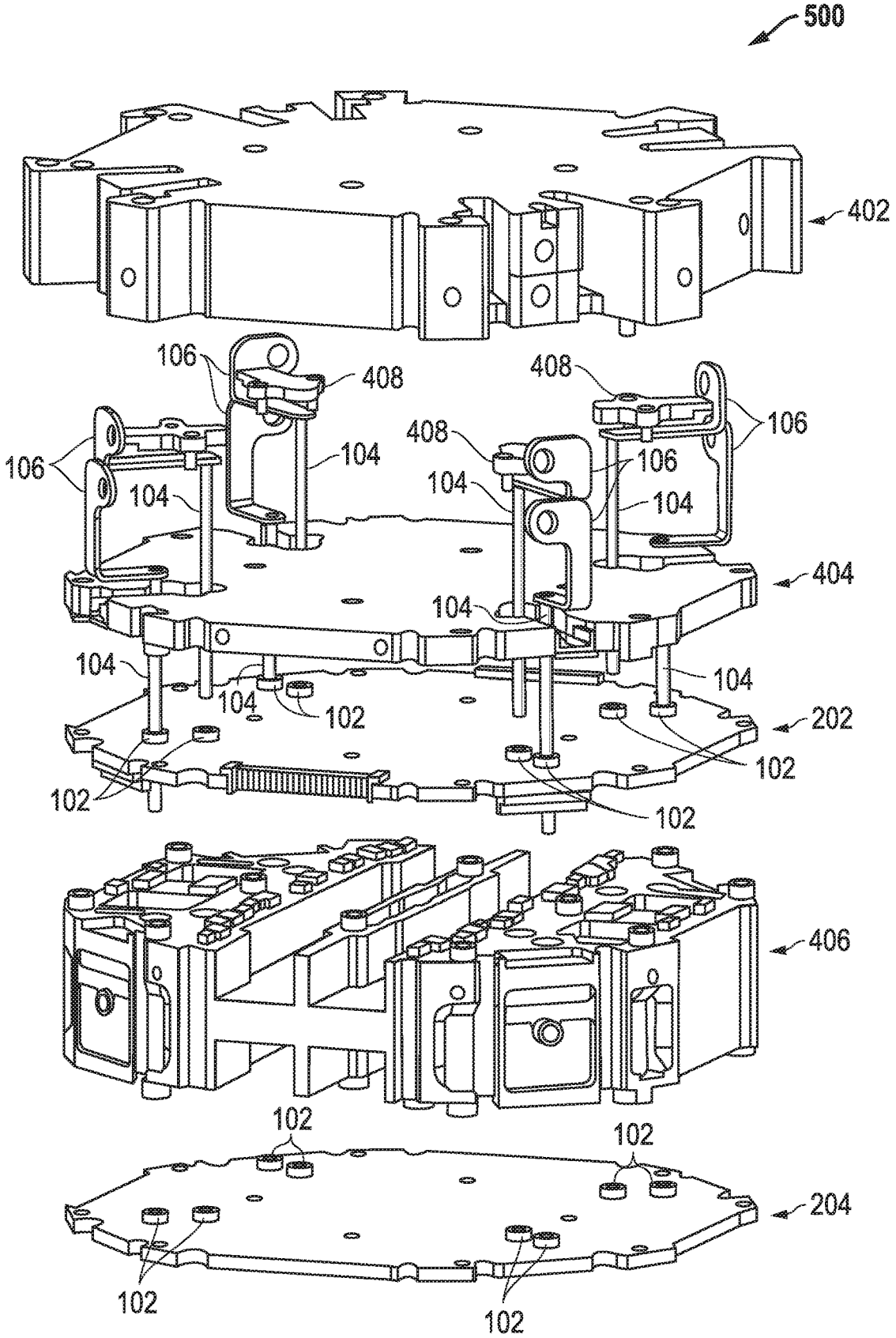
FIG. 5 provides an example embodiment for a perspective view of an overall assembly that includes metal structures in addition to two circuit card assemblies similar to what is shown in FIG. 2.

For the example embodiment depicted, the socket connector 102 includes a top portion 154 that has a larger diameter than a bottom portion 156. As shown in FIGS. 4-5, the bottom portion 156 is positioned with holes formed within the CCAs, and the top portion 154 rests on the top surface of the CCAs. For one embodiment, the socket connector 102 is implemented as a commercially available socket connector, such as a socket connector available from Amphenol with the part number 10-700303-24. This commercially available socket connector is intended for use with fixed connection pins. However, rather than use a fixed connection pin, the bus bar contacts 110 described herein are used. The socket connector 102 can be made from materials such as copper, brass, aluminum, and/or other conductive materials. Other socket connectors can also be used.

FIG. 1C provides a further perspective view for the bus bar contact 110. As described above, the bus bar contact 110 includes a rod 104 and a bar 106, and the bar 106 has a connector 108. As described herein, the bar 104 passes through, and makes electrical contact with, the axial borehole 152 within the socket connector 102. The bar 106 is shaped so that it can be routed out of the overall system assembly to an electrical connection on the edge of the assembly. The connector 108 is used to connect the bar 106 to this electrical connection, such a bus bar.

For one embodiment, the bar 106 has a first portion 114 with flat surfaces that extend perpendicular to an axial direction 112 for the rod 104 and a second portion 116 that includes the connector 108. For a further embodiment, the second portion 116 also includes flat surfaces that extend in a plane perpendicular to the plane for the first portion 114. As described herein, the connector 108 can be an opening, as shown, through which a screw, pin, or other connector is used to couple or otherwise connect the connector 108 to a conductive component such as a bus bar. Further, with respect to FIGS. 4-5 below, it is noted that the first portion 114 for any particular bar 106 can be adjusted in length and/or direction so as to route the bus bar contact 110 to the edge of the electronic assembly. It is also noted that the flat surfaces for the first portion 114 of the bar 106 preferably extend in a parallel plane to the plane of one or more adjacent CCAs. Further, the first portion 114 can have one or more changes of direction and/or turns as it is routed to the outer edge of the electronic system. It is further noted that the rod 104, bar 106, and connector 108 can also be implemented using other components, materials, and variations while still taking advantage of the techniques described herein.

Figure 2:
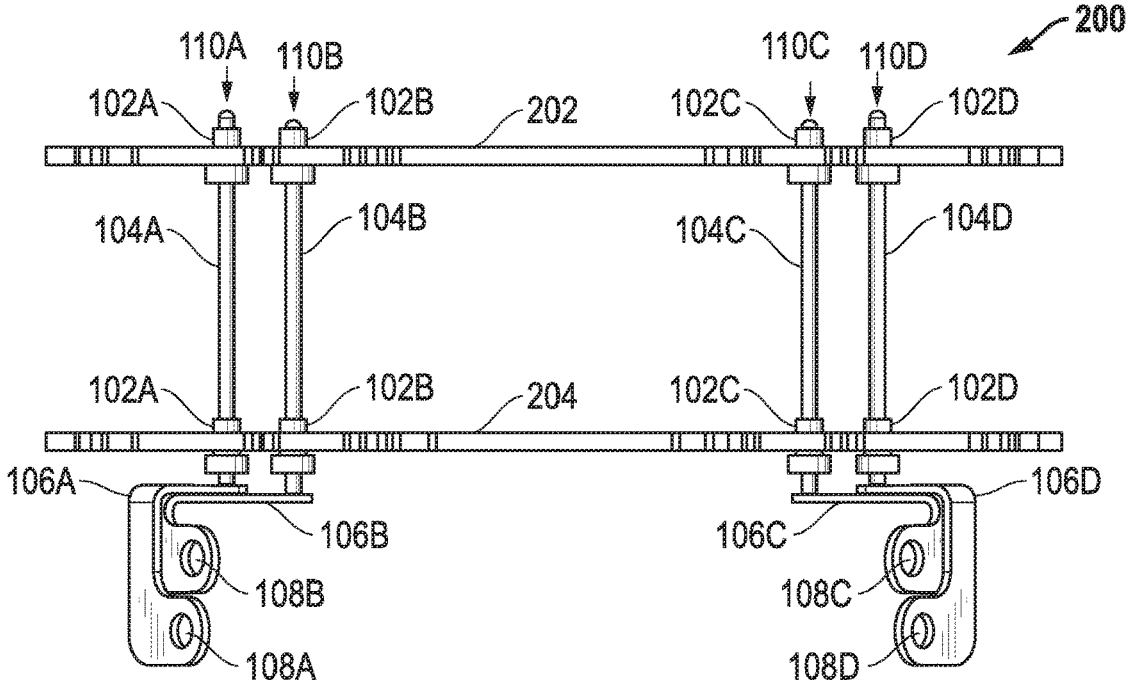
FIG. 2 provides an example embodiment where four bus bar contacts are connected to socket connectors within two circuit card assemblies.

FIG. 2 provides an example embodiment 200 where four bus bar contacts 110A, 110B, 110C, and 110D are connected to socket connectors 102A, 102B, 102C, and 102D within two CCAs 202 and 204. The rod 104A for the bus bar contact 110A makes contact with the socket connectors 102A within CCAs 202 and 204. The rod 104B for the bus bar contact 110B makes contact with the socket connectors 102B within CCAs 202 and 204. The rod 104C makes contact with the socket connectors 102C within CCAs 202 and 204. The rod 104D makes contact with the socket connectors 102D within CCAs 202 and 204. The bars 106A, 106B, 106C, and 106D are routed out to the edge of the electronic assembly so that the connectors 108A, 108B, 108C, and 108D can be connected to electrical connections or contacts at the edge of the overall assembly, as shown for example with respect to FIGS. 4-5.

For one embodiment, the CCAs includes multiple electronic components coupled to a board made of an insulative material, such as a molded plastic material. The electronic components for the CCA are further electrically connected within or through the board using one or more electrical wires, conductive paths, interconnects, and/or other electrical connections. For a further embodiment, CCAs are implemented using printed circuit boards (PCBs). As described herein, the CCAs include holes or vias through which the rods 104 for the bus bar contacts 110 pass through the CCAs. When a connection is desired, the rods 104 are passed through socket connectors 102 are positioned within the CCAs.

Figure 3:
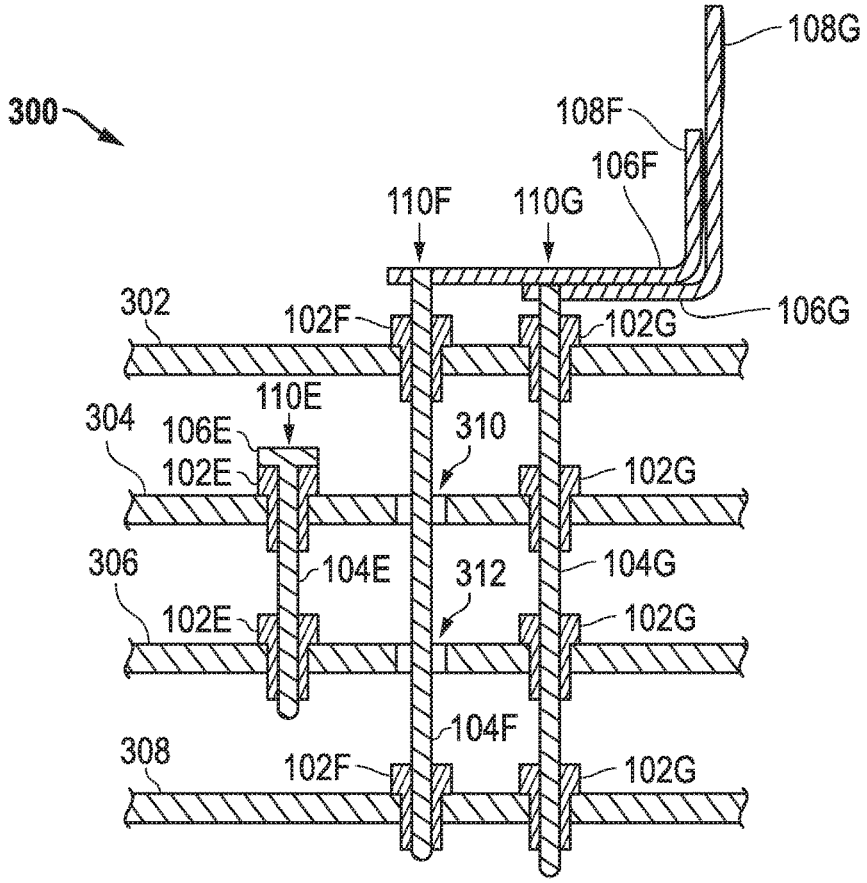
FIG. 3 provides an example embodiment where three bus bar contacts are connected to socket connectors within four circuit card assemblies.

FIG. 3 provides an example embodiment 300 where three bus bar contacts 110E, 110F, and 110G are connected to socket connectors 102E, 102F, and 102G within four CCAs 302, 304, 306, and 308. The rod 104E makes contact with the socket connectors 102E within CCAs 304 and 306, and the bar 106E simply terminates above CCA 304 as this is a connection that is completely internal to the overall assembly. The rod 104F makes contact to the socket connectors 102F within the CCAs 302 and 308 while skipping electrical connections to CCAs 304 and 306. In particular, the rod 104F passes through holes 310 and 312 formed within CCAs 304 and 306 without making electrical connections to electronical circuitry within the CCAs 304 and 306. These holes 310/312 can be similar to other holes within the CCAs 302/304/306/308 within which the socket connectors 102E/102F/102G are positioned. The rod 104G makes contact with socket connectors 102G within each of the CCAs 302, 304, 306, and 308. The bars 106F and 106G are routed out of the assembly so that the connectors 108F and 108G can be connected to electrical contacts at the edge of the overall assembly, as shown in further detail with respect to FIGS. 4-5.

FIG. 4 provides an example embodiment 400 for a cross-section view of an overall electronic assembly that includes metal structures 402, 404, and 406 in addition to two CCAs 202 and 204, similar to what is shown in FIG. 2. The metal structure 402 is used in part to supply current to the bus bar contacts 110. The metal structures 404 and 406 can be used to provide a heat sink during operation of the overall assembly. As described herein, the rods 104 make contact with the socket connectors 102 within CCAs 202 and 204. Insulator layers 408 are included above and below the bars 106 to protect them from undesired electrical contacts to metal structures 402/404 and CCA 202. Insulator tubes 410 are provided within the metal structure 406 to protect the bus bar contacts 110 from undesired electrical contacts to the metal structure 406. The bars 106 are routed out of the overall assembly, and the connectors 108 are connected to the metal structure 402. It is noted that embodiment 400 is one example embodiment for an electronic assembly, and different and/or varied electronic assemblies can be used while still taking advantage of the bus bar contact techniques described herein.

FIG. 5 provides an example embodiment 500 for a perspective view of an overall assembly that includes metal structures 402, 404, and 406 in addition to two CCAs 202 and 204 similar to what is shown in FIG. 2. As with FIG. 4, the metal structure 402 is used to supply current to the bus bar contacts 110. The metal structures 404 and 406 can be used to provide a heat sink during operation of the overall assembly. The rods 104 for the bus bar contacts 110 make contact with the socket connectors 102 within CCAs 202 and 204. Insulator layers 408 are used to protect from undesired electrical contacts to metal structures 402/404 and CCA 202. Insulator tubes, as shown in FIG. 4, can also be included within the metal structure 406 to protect from undesired electrical contacts to the metal structure 506. The bars 106 are routed out of the overall assembly for connections to the metal structure 402. It is noted that embodiment 500 is one example embodiment for an electronic assembly, and different and/or varied electronic assemblies can be used while still taking advantage of the bus bar contact techniques described herein As shown in FIGS. 4 and 5, one or more insulator layers 408 and insulator tubes 410 can be included or imbedded into the metal structures 402, 404, and 406 to insulate the rods 104 and/or the bars 106 for the bus bar contacts 110 from undesired contact with other conductive components or surfaces. It is further noted that portions of the bars 106 for the bus bar contacts 110 can also be powder coated with an insulating material to insulate them from each other, although the connectors 108 would not be powder coated so that electrical connections could still be made. It is further noted that different and or additional techniques could also be used to insulate the bus bar contacts 110 while still taking advantage of the techniques described herein.

The disclosed embodiments are particularly useful to connect electronic circuits within multiple high current CCAs where currents of 20 to 40 Amps (A) or more are being supplied through the bus bar contacts 110 to electronic circuits within the CCAs. For certain embodiments, voltages being supplied through the bus bar contacts 110 are between 1 to 30 volts (V), and other embodiments supply voltages through the bus bar contacts 110 of between 1 to 100 volts. Other current and/or voltages can also be used.

Further modifications and alternative embodiments of this invention will be apparent to those skilled in the art in view of this description. It will be recognized, therefore, that the present invention is not limited by these example arrangements. Accordingly, this description is to be construed as illustrative only and is for the purpose of teaching those skilled in the art the manner of carrying out the invention. It is to be understood that the forms of the invention herein shown and described are to be taken as the presently preferred embodiments. Various changes may be made in the implementations and architectures. For example, equivalent elements may be substituted for those illustrated and described herein, and certain features of the invention may be utilized independently of the use of other features, all as would be apparent to one skilled in the art after having the benefit of this description of the invention.

What is claimed is:

1. An electronic assembly, comprising:

a plurality of circuit card assemblies (CCAs) for the electronic assembly, the plurality of CCAs each comprising a plurality of electronic components coupled to a board;

a plurality of socket connectors coupled within the plurality of CCAs; and a bus bar contact, comprising:

a rod positioned to extend through two or more socket connectors within two or more CCAs, the rod being in electrical contact with the two or more socket connectors; and a bar coupled to the rod and having a first portion extending to an outer edge of the electronic assembly.

2. The electronic assembly of claim 1, wherein a plurality of bus bar contacts are included within the electronic assembly.

3. The electronic assembly of claim 1, wherein the bus bar contact extends through and is in electrical contact with a socket connector in each of the CCAs.

4. The electronic assembly of claim 1, wherein the rod for the bus bar contact extends through an opening within at least one of the CCAs without making an electrical contact with the at least one CCA.

5. The electronic assembly of claim 1, further comprising an additional bus bar contact without a bar extending to the outer edge of the electronic assembly, the additional bus bar contact remaining internal to the electronic assembly.

6. The electronic assembly of claim 1, wherein the bar also has a second portion with a connector.

7. The electronic assembly of claim 6, wherein the connector for the second portion of the bar is coupled to a metal structure for the electronic assembly.

8. The electronic assembly of claim 7, wherein the bus bar contact and the metal structure are configured to carry a current of 20 or more Amps during operation of the electronic assembly.

9. The electronic assembly of claim 8, wherein the bus bar contact and the metal structure are configured to carry a voltage of between 1 to 100 volts during operation of the electronic assembly.

10. The electronic assembly of claim 1, wherein the first portion of the bar has flat surfaces and extends in a parallel plane with respect to at least one of the plurality of CCAs.

11. The electronic assembly of claim 10, wherein the first portion of the bar has multiple changes of direction within its routing to the outer edge of the electronic assembly.

12. An electronic assembly, comprising:

a plurality of circuit card assemblies (CCAs) for the electronic assembly;

a plurality of socket connectors coupled within the plurality of CCAs; and a bus bar contact, comprising:

a rod positioned to extend through two or more socket connectors within two or more CCAs, the rod being in electrical contact with the two or more socket connectors; and a bar coupled to the rod and having a first portion extending to an outer edge of the electronic assembly;

wherein the first portion of the bar has flat surfaces and extends in a parallel plane with respect to at least one of the plurality of CCAs; and wherein the bar also has a second portion with a connector, the second portion having flat surfaces and extending in a plane perpendicular to a plane for the first portion.

13. The electronic assembly of claim 1, wherein the bus bar contact comprises copper or a copper alloy.

14. The electronic assembly of claim 1, further comprising insulating material positioned adjacent at least a portion of the bus bar contact.

15. An electronic assembly, comprising:

a plurality of circuit card assemblies (CCAs) for the electronic assembly;

a plurality of socket connectors coupled within the plurality of CCAs; and a bus bar contact, comprising:

a rod positioned to extend through two or more socket connectors within two or more CCAs, the rod being in electrical contact with the two or more socket connectors;

a bar coupled to the rod and having a first portion extending to an outer edge of the electronic assembly; and insulating material positioned adjacent at least a portion of the bus bar contact;

wherein the insulating material comprises at least one of an insulator tube positioned around the rod for the bus bar contact or a coating on at least a portion of the bar or the rod for the bus bar contact.

16. The electronic assembly of claim 14, wherein the insulating material comprises one or more insulator layers positioned adjacent the bar for the bus bar contact.

* * * * *